United States Patent [19]

Yamamoto et al.

[11] Patent Number: 4,870,049

[45] Date of Patent: Sep. 26, 1989

[54] HEAT SENSITIVE PAPER

[75] Inventors: Yoichi Yamamoto, Nara; Toshio Takehara, Nabari; Hironori Fujii, Osaka; Koji Uhara; Hirofumi Tanaka, both of Wakayama, all of Japan

[73] Assignees: Sharp Kabushiki Kaisha, Osaka; Sugai Chemical Ind. Co., Ltd., Wakayama, both of Japan

[21] Appl. No.: 923,122

[22] Filed: Oct. 24, 1986

[30] Foreign Application Priority Data

Oct. 25, 1985 [JP] Japan ..... 60-239677
Oct. 25, 1985 [JP] Japan ..... 60-239678

[51] Int. Cl.[4] ..... B41M 5/18

[52] U.S. Cl. ..... 503/217; 427/150; 427/152; 428/913; 428/914; 503/209; 503/216; 503/218; 503/226

[58] Field of Search ..... 503/216, 217, 218, 225, 503/215, 200, 226, 209, 213, 214; 427/150–152; 428/913, 914

[56] References Cited

U.S. PATENT DOCUMENTS 4,520,378 5/1985 Matsushita et al. ..... 503/209
4,561,000 12/1985 Tsujimoto et al. ..... 503/208
4,598,035 7/1986 Usami et al. ..... 430/138

*Primary Examiner*—Bruce H. Hess
*Attorney, Agent, or Firm*—Birch, Stewart, Kolasch & Birch

[57] ABSTRACT

Disclosed is a heat sensitive sheet which can develop a black image having excellent oil and light resistance, comprising a combination of a record sheet to be printed and a transfer sheet for forming an image on said record sheet, wherein said record sheet is coated with a solution comprising an organic or inorganic nickel compound an an organic and inorganic copper compound and said transfer sheet is coated with dithiooxamide. The present invention also provides a transfer sheet which can form a printed black image having excellent oil and light resistance on any type of record sheets. The transfer sheet is coated with an organic compound having a phenolic hydroxyl group or an amino group directly bonded to aromatic ring and quinone or a quinone derivative substituted by an electron attractive group in such a condition that the organic compound is not reacted with quinone or the quinone derivative.

8 Claims, 1 Drawing Sheet

HEAT SENSITIVE PAPER

FIELD OF THE INVENTION

The present invention relates to a set of heat sensitive paper which obtains a printed image having good oil and light resistance.

BACKGROUND OF THE INVENTION

A heat sensitive paper is known which employs sublimable materials such as sublimable dyes. The heat sensitive paper comprises a record sheet coated with a developer and a transfer sheet which faces the record sheet and which is coated with a dye. The dyes on the transfer sheet are sublimed or evaporated by heat onto the record sheet and reacted with the developer on the record sheet to obtain a color-developed image.

The most important color of such heat sensitive paper is black. However, no black dyes which are sublimed by using a small amount of heat energy have been proposed. Japanese Patent Publication (unexamined) No. 220788/1983 discloses a process wherein a sublimable basic dye is transferred to a pretreated sheet to develop a color. The developed color of the disclosed process is restricted to magenta, cyan and yellow, because no black dyes which can be easily sublimed by a heat energy of a conventional thermal head are known.

In order to the above mentioned defects, the present inventors have proposed heat sensitive paper in Japanese Patent Applications 154879/1984 and 17257/1985. The heat sensitive paper develops a good black color, but exhibits defects in oil and light resistance.

SUMMARY OF THE INVENTION

The present invention to provides heat sensitive paper which can develop a black image having excellent oil and light resistance. The heat sensitive sheet of the present invention comprises a combination of a record sheet to be printed and a transfer sheet for forming an image on said record sheet, wherein said record sheet is coated with an organic or inorganic nickel compound and an organic and inorganic copper compound and said transfer sheet is coated with dithiooxamide.

The present invention also provides a transfer sheet which can form a black image having excellent oil and light resistance on any type of record sheet. The transfer sheet is coated with an organic compound having a phenolic hydroxyl group or an amino group directly bonded to aromatic ring and quinone or a quinone derivative substituted by an electron attractive group in such a condition that the organic compound is not reacted with quinone or the quinone derivative.

DETAILED DESCRIPTION OF THE PRESENT INVENTION

(First embodiment)

The nickel compounds and copper compounds useful in the first embodiment of the present invention are nickel or copper salts of organic or inorganic acids.

Examples of the organic acids are fatty acids having the formula: $C_nH_{2n+1}COOH$ wherein n is an integer of 1 to 20, such as acetic acid, stearic acid and the like; aromatic carboxylic acids such as phthalic acid, terephthalic acid, trimellitic acid, pyromellitic acid, salicylic acid and the like; and aromatic sulfonic acids such as benzenesulfonic acid, naphthalenesulfonic acid and the like. Examples of the inorganic acids are sulfuric acid, chloric acid, phosphoric acid, nitric acid and the like. The nickel compounds can be used separately or in a mixture and the copper compounds can also be used separately or in a mixture.

In order to obtain a good black color, the atomic ratio of the nickel ion to the copper ion is adjusted to the range of from 1:99 to 99:1. Preferably, the atomic ratio is from 18:5 to 1:10 when an organic or inorganic nickel compound is combined with an inorganic copper compound, and is from 18:5 to 1:1 when an organic or inorganic nickel compound is combined with an organic copper compound.

Figure 1:
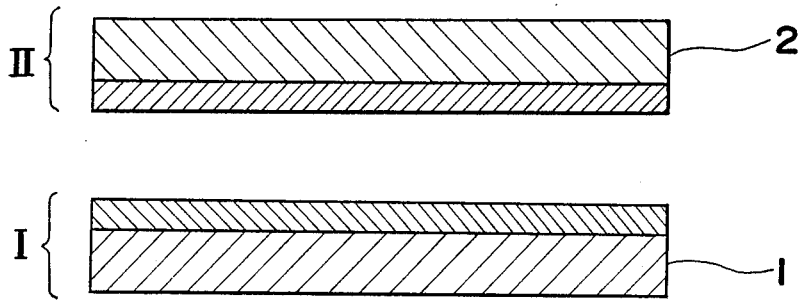
FIG. 1 is a sectional view schematically showing the first embodiment of the present invention.

As illustrated in FIG. 1, the record sheet I to be printed of the present invention may be prepared by coating a substrate sheet 1 with a coating solution containing the nickel compound, the copper compound and a suitable solvent and then drying. The amount of the nickel and copper compound is not limited, but is typically from 1 to 50% by weight of the coating solution. Examples of the solvents are water; alcohols, such as methanol; glycols, such as polyethylene glycol; ketones, such as acetone; esters, such as methyl ethyl ester; alkyl halides, such as dichloroethane; aromatic hydrocarbons, such as toluene, xylene; and the like. The coating solution may further contain a binder and an additive if necessary. Examples of binders are acetylcellulose, polyvinylalcohol, methylcellulose, ethylcellulose, methoxycellulose, hydroxyethylcellulose, carboxymethylcellulose, carboxymethoxymethylcellulose, polyvinylpyrrolidone, polyacrylamide, polyacrylic acid, starch, gelatine, polystyrene, polyurethane, polyvinylchloride, vinylchloride-vinylacetate copolymers, styrene-butadiene latex, polybutyl methacrylate, water-soluble polyesters, polyacetic acid, nitrocotton, gum arabic, tannin, rosin, polyethylene and the like. Examples of additives are 2,2-bis(4-hydroxyphenyl)propane, calcium chloride, silica, wax, calcium carbonate, a compound having a maximum absorption wavelength of 490 to 560 nm, fluorescent dyes, white pigments and the like. By the term "coat" it is meant that the nickel and copper compounds are placed on the substrate sheet 1 or contained in the substrate sheet matrix by any means. A method for coating can be spray coating, immersing and the like. The coating solution containing the nickel compound and the copper compound can be typically applied to the sheet in a dried amount of 1 to 30 $g/m^2$, preferably 5 to 20 $g/m^2$. If the record sheet I is required to be smooth, it can be subjected to a known smoothing finish by a supercalendar, a machinecalender and the like. The substrate sheet 1 used in the present invention may be paper, a plastic film, synthetic paper, a metal film and the like. Paper is a most preferred due to cost, suitability for coating and the like.

The transfer sheet II of the present invention can be prepared by coating a base sheet 2 with dithiooxamide and drying. Since dithooxamide is solid in a surrounding condition, it is generally dissolved in a solvent when coated and optionally a binder is added. Examples of the solvents and binders are the same as described above. The amount of dithiooxamide is not limited, but typically from 1 to 50% by weight of the dithiooxamide containing liquid. The liquid containing dithiooxamide is typically applied to the base sheet 2 in a dried amount 0.1 to 3 g/m$^2$, preferably 0.3 to 10. The base sheet 2 of the recording medium II is not limited, but typically polyester film, paper, cellophane, a polycarbonate film, a polyvinyl chloride film, a polystyrol film, a cellulose acetate film, a metallic foil and the like.

Figure 2:
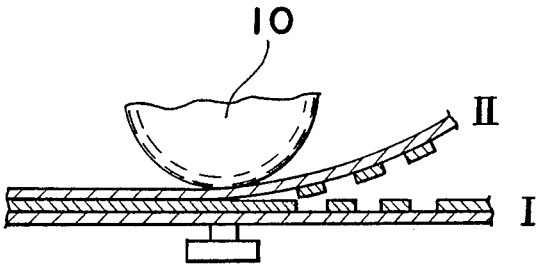
FIG. 2 is a sectional view schematically showing an application of the embodiment of FIG. 1 to a thermal head.

In the first embodiment of the present invention, the record sheet I to be printed is combined with the transfer sheet II as shown in FIG. 2. Dithiooxamide of the transfer sheet II is sublimated or evaporated by heat of a thermal head 10 and transferred onto the sheet I. On the record sheet I, the transferred dithiooxamide is reacted with the nickel and copper compound to obtain a colored image.

(Second embodiment)

According to the second embodiment of the present invention, a transfer sheet A is coated with an aromatic compound and quinone or a quinone derivative. In this embodiment, a record sheet B to be printed has no coating layer.

The aromatic compound has a phenolic hydroxyl group or an amino group directed bonded to an aromatic ring. Examples of the aromatic compounds are 3,3'-dihydroxydiphenylamine, o-phenylenediamine, 4-chloro-o-phenylenediamine, 4-nitro-o-phenylenediamine, 2,4-tolylenediamine, 5-nitrotolylene-2,4-diamine, 4-methoxy-o-phenylenediamine, 4-methoxy-m-phenylenediamine, p-phenylenediamine, 2-chloro-p-phenylenediamine, 2-nitro-p-phenylenediamine, N,N-dimethyl-p-phenylenediamine, 3-(p-aminoanilino)-1,2-propanediol, p-aminodiphenylamine, o-methoxy-p'-aminodiphenylamine, p,p'-diaminodiphenylamine, p,p'-bisdimethylaminodiphenylamine, o-aminophenol, m-aminophenol, 2-amino-4-chlorophenol, 2-amino-4-nitrophenol, 2-amino-5-nirtrophenol, picramic acid, p-aminophenol, 4-amino-2-nitrophenol, p-amino-p'-hydroxyxdiphenylamine, p-amino-m-methyl-p'-hydroxydiphenylamine, 1-naphthol, 4-methoxy-1-naphthol, 1,5-dihydroxynaphthalene, 2,5-dimethoxyaniline, 1,5-diaminonaphthalene, 2-nitroso-1-naphthol, 1,6-dihydroxynaphthalene, 1,7-dihydroxynaphthalene, 2,6-dihydroxynaphthalene, 2,7-dihydroxynaphthalene, 5-amino-1-naphthol, pyrocatechol, resorcinol, p-aminoacetoanilide, m-phenylenediamine, 4-chloromethaphenylenediamine, 4-chlororesorcinol, 4-nitromethaphenylenediamine, 2,5-diaminotoluene, 2-chlorotoluene-3,5-diamine, 4-ethoxy-m-phenylenediamine, pyrogallol, phloroglucin, a mixture thereof and the like.

The quinone and quinone derivative (hereinafter referred to as "quinones") are materials which are reacted with the aromatic compound to develop a black color. The quinone derivatives are those substituted by an electron attractive group, preferably having the following formula:

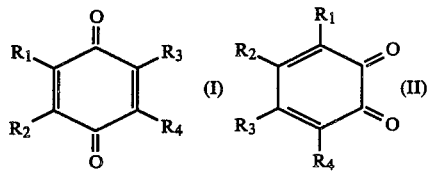

wherein at least one of $R_1$ to $R_4$ represents a halogen atom or a cyano group, and the other R substituents represent a hydrogen atom or an alkyl group having 1 to 8 carbon atoms, preferably 1 to 3 carbon atoms. Representative examples of the halogen-containing compounds are 2-chloro-1,4-benzoquinone, 3-chloro-1,2-benzoquinone, 4-chloro-1,2-benzoquinone, 3,4-dibromo-5,6-dicyano-1,2-benzoquinone, 2,3,5,6-tetraiodo-1,4-benzoquinone, 2,3,5,6-tetraiode-1,4-benzoquinone, 3,4,5,6-tetrachloro-1,2-benzoquinone, 2,3,5,6-tetrachloro-1,4-benzoquinone, 2,3,5,6-tetrafluoro-1,4-benzoquinone, 2,3,5-trichloro-1,4-benzoquinone, 2,5-dichloro-1,4-benzoquinone, 2,5-difluoro-1,4-benzoquinone, 3,4,5,6-tetrafluoro-1,2-benzoquinone and the like. Representative examples of the cyano group-containing compounds are 2-cyano-1,4-benzoquinone, 3-cyano-1,2-benzoquinone, 4-cyano-1,2-benzoquinone, 2,3-dicyano-5,6-dichloro-1,4-benzoquinone, 2,3,5,6-tetracyano-1,4-benzoquinone and the like.

Figure 3:
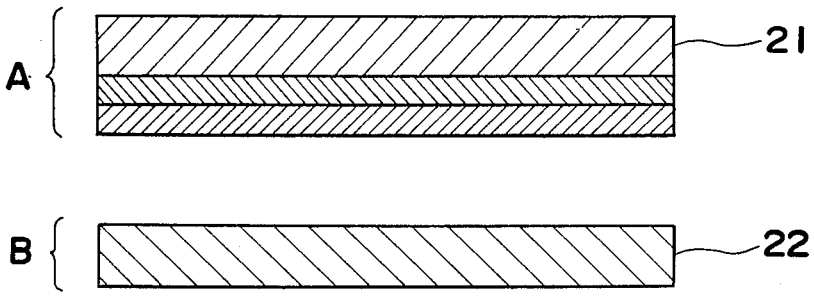
FIG. 3 is a sectional view schematically showing the second embodiment of the present invention.

The transfer sheet of the present invention is coated with the organic compound and the quinones. However, since the organic compound is reacted with the quinones to form a black product, it is not preferred to mix them before coating. Accordingly, they are coated on a base sheet 21 in such a condition that they are not reacted with each other. For example, they may be respectively coated as in a layer construction, which is shown in FIG. 3, or one of them may be encapsulated and mixed with the other and then coated on the base sheet 21. The coating method employed may be spray coating, immersing and the like. The organic compounds and quinones are usually mixed with a solvent and optionally a binder and additives to form a mixture. Examples of the solvents, binders and additives are the same as mentioned in the first embodiment. The amount of the solvent and the other additives are 50 to 90% by weight.

The base sheet 21 is not limited, but typically the same as mentioned about the base sheet 2 of the first embodiment. According to the present invention, the substrate sheet can be formed from any sheet materials such as paper and the like.

The present invention is illustrated by the following examples, which are not to be construed as limiting the invention to their details. All parts in the examples are by weight unless otherwise specified.

EXAMPLE 1

One part of a mixture of the nickel salt and the copper salt shown in Table 1 was dispersed with one part of a 22% polyethylene glycol solution, 5 parts of methanol, 0.5 parts of a 10% polyvinyl alcohol solution (polymerization degree 500) and 50 parts of water in a ball mil for 10 hours. The resultant dispersion was coated on a sheet of high grade paper in a dried amount of 10 g/m$^2$ to form a record sheet. The color of the sheet before a color development is shown in Table 1.

TABLE 1

| Nickel salts | Copper salts | Atom ratio of $Ni^{2+}$ ion:$Cu^{2+}$ ion 10:1 | 3.6:1 | 1.2:1 | 0.4:1 | 0.1:1 | 0:10 |
|---|---|---|---|---|---|---|---|
| Nickel stearate | Copper sulfate | x | o | o | o | o | x |
| Nickel stearate | Copper stearate | x | o | o | x | x | x |
| Nickel chloride | Copper stearate | x | o | o | x | x | x |
| Nickel chloride | Copper sulfate | x | o | o | o | o | x |
| Nickel stearate | Copper chloride | x | o | o | o | o | x |
| Nickel acetate | Copper chloride | x | o | o | o | o | x |
| Nickel stearate | Copper acetate | x | o | o | x | x | x |
| Nickel sulfate | Copper stearate | x | o | o | x | x | x |

The color of the substrate sheet before a color development:
o: Tinged with blue (within the limits of use);
x: blue One part of dithiooxamide and 0.05 parts of acetylcellulose were dissolved in 50 parts of N-dimethylformamide to form a coating liquid. The liquid was coated on a polyester film in a dried amount of one g/m$^2$ to obtain a transfer sheet. The transfer sheet was faced with the record sheet obtained above to obtain a set of heat sensitive paper of the present invention.

The heat sensitive paper set was applied to a thermal printer to develop a black image. The color of the printed image is shown in Table 2.

TABLE 2

| Nickel salts | Copper salts | Atom ratio of $Ni^{2+}$ ion:$Cu^{2+}$ ion 10:1 | 3.6:1 | 1.2:1 | 1:1 | 0.4:1 | 0.1:1 | 0:100 |
|---|---|---|---|---|---|---|---|---|
| Nickel stearate | Copper sulfate | x | o | o | o | o | o | x |
| Nickel stearate | Copper stearate | x | o | o | o | Δ | Δ | x |
| Nickel chloride | Copper stearate | x | o | o | o | Δ | Δ | x |
| Nickel chloride | Copper sulfate | x | o | o | o | o | o | x |
| Nickel stearate | Copper chloride | x | o | o | o | Δ | Δ | x |
| Nickel acetate | Copper chloride | x | o | o | o | o | o | x |
| Nickel stearate | Copper acetate | x | o | o | o | Δ | Δ | x |
| Nickel sulfate | Copper stearate | x | o | o | o | Δ | Δ | x |

The color after a color development:
o: good;
x: bad;
Δ: good in color development, but a substrate sheet before a color development is tinged with blue.

EXAMPLE 2

The nickel and copper compound shown in Table 3 were employed and color-developed as generally described in Example 1. The developed image was subjected to a light-fastness test. The test was carried out by exposing the color-developed sheet to a high pressure mercury vapor lamp at a distance of 5 cm for 20 hours. Color strength before and after exposing was determined by a reflection densitometer available from Macbeth Co. Ltd. and the result is shown in Table 3.

For comparison, the same test was carried out by a set of conventional heat sensitive paper coated with a fluorane dye. The result is shown in Table 3.

TABLE 3

| | $Ni^{2+}$ ion | $Cu^{2+}$ ion | Ni:Cu = 3.6:1 before | after | Ni:Cu = 1.2:1 before | after |
|---|---|---|---|---|---|---|
| Example | Nickel stearate | Copper sulfate | 1.33 | 1.33 | 1.24 | 1.24 |
| | Nickel stearate | Copper stearate | 1.25 | 1.23 | 1.36 | 1.35 |
| | Nickel chloride | Copper stearate | 1.45 | 1.45 | 1.22 | 1.22 |
| | Nickel chloride | Copper sulfate | 1.32 | 1.31 | 1.37 | 1.37 |
| | Nickel stearate | Copper chloride | 1.25 | 1.25 | 1.41 | 1.40 |
| | Nickel acetate | Copper chloride | 1.16 | 1.16 | 1.35 | 1.35 |
| | Nickel stearate | Copper acetate | 1.21 | 1.21 | 1.41 | 1.41 |
| | Nickel sulfate | Copper stearate | 1.29 | 1.28 | 1.20 | 1.20 |
| | Comparative example | | 1.06 | 0.93 | — | |

Further, the developed image was subjected to an oil resistance test. The test was carried out by dropping bean oil on the developed image. The color change was observed. Color change was not observed in any samples of the present invention, but, in the comparative sample employing the fluorane dye, the color disappeared.

EXAMPLE 3

One part of one of the compound (1) infra and 0.05 parts of a suitable binder were dissolved in 10 parts of methanol to form a first coating solution. The first solution was coated on a polyester film in a dried amount of about 0.5 g/m$^2$. One part of one of the compound (2) infra and 0.05 parts of a auitable binder were dissolved in 10 parts of water to form a second coating solution. The second solution was coated on the polyester film having been coated with the first solution to form a transfer sheet of the second embodiment of the present invention. The transfer sheet was faced with a sheet of high grade paper to obtain a heat sensitive paper of the present invention.

The heat sensitive paper set was applied to a thermal printer to develop a black image. The color of the printed image is shown in Table 4.

Compound (1)

(1) 3,3'-dihydroxydiphenylamine, (2) 4-chloro-o-phenylenediamine, (3) 2,4-tolylenediamine, (4) 2-chloro-p-phenylenediamine, (5) 2-nitro-p-phenylenediamine, (6) N,N-dimethyl-p-phenylenediamine, (7) p-aminodiphenylamine, (8) o-methoxy-p'-aminodiphenylamine, (9) o-aminophenol, (10) m-aminophenol, (11) 2-amino-4-chlorophenol, (12) p-aminophenol, (13) p-amino-p'-hydroxyxdiphenylamine, (14) p-amino-m-methyl-p'-hydroxydiphenylamine, (15) 1-naphthol, (16) 4-methoxy-1-naphthol, (17) 1,5-dihydroxynaphthalene, (18) 2,5-dimethoxyaniline, (19) 1,5-diaminoaphthalene, (20) 1,6-dihydroxynapthalene, (21) 1,7-dihydroxynaphthalene, (22) pyrogallol, (23) 4-methoxy-4'-aminodiphenylamine, (24) 3,4-methylenedioxyaniline, (25) 2,4-diaminoanisol, (26) p-hydroxydiphenylamine, (28) m-hydroxydiphenylamine, (30) anidol.

Compound (2)

(1) 3,4,5,6-tetrachloro-1,2-benzoquinone, (2) 2,3,5,6-tetrachloro-1,4-benzoquinone, (3) 2,3-dicyano-5,6-dichloro-1,4-benzoquinone.

TABLE 4

| Compound | Compound (1) | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| (2) | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 |
| 1 | ◎ | ○ | ○ | ◎ | ◎ | ◎ | ◎ | ◎ | ○ | ○ | | ○ | ◎ | ◎ | | | | | ◎ | | | | ◎ | | | | | ○ |
| 2 | ◎ | ○ | ○ | ◎ | ○ | ◎ | ◎ | ◎ | | | ○ | ○ | ◎ | ◎ | ○ | ○ | ○ | ○ | ◎ | ○ | ○ | ○ | ◎ | ○ | ○ | | ○ | |
| 3 | ◎ | ○ | ○ | ◎ | ◎ | ◎ | ◎ | ◎ | | | | ○ | ◎ | ◎ | | | | | | | | | ◎ | | | ○ | | |

: Very good color;
: Fairly good color (i.e. black tinged with blue or red)

EXAMPLE 4

3,3-dihydroxydiphenylamine and 3,4,5,6-tetrachloro-1,2-benzoquinone were employed and color-developed as generally described in Example 1. The developed image was subjected to a light-fastness test. The test was carried out by exposing the color-developed sheet to a high pressure mercury vapor lamp at a distance of 5 cm for 20 hours. Color strength before and after exposing was determined by a reflection densitometer available from Macbeth Co. Ltd. and the result is shown in Table 5.

For comparison, the same test was carried out by using a set of conventional heat sensitive paper coated with a fluorane dye. The result is shown in Table 5.

TABLE 5

| | Example | | Comparative example | |
|---|---|---|---|---|
| | Before exposure | After exposure | Before exposure | After exposure |
| Black (total) | 1.12 | 1.12 | 1.06 | 0.93 |
| Yellow component | 1.19 | 1.17 | 1.10 | 1.08 |
| Magenta component | 1.23 | 1.21 | 1.09 | 1.03 |
| Cyan component | 1.19 | 1.19 | 0.98 | 0.76 |

Compound combinations shown in Table 6 were adopted and a light-fastness test is conducted as generally described above. The result is shown in Table 6.

TABLE 6

| | | | | | |
|---|---|---|---|---|---|
| Component (1) | 4 | 6 | 8 | 14 | 19 |
| Component (2) | 3 | 3 | 2 | 1 | 2 |
| Before exposure | 1.13 | 1.11 | 1.41 | 1.27 | 1.32 |
| After exposure | 1.13 | 1.10 | 1.41 | 1.25 | 1.32 |

Further, the developed image was subjected to an oil resistance test. The test was carried out by dropping soy bean oil on the developed image. The color change was observed. Color change was not observed in any samples of the present invention, but, in the comparative sample employing the fluorane dye, its color was disappeared.

What is claimed is:

1. A transfer sheet used to form a printed image, having excellent oil and light resistance, on a record sheet, wherein said transfer sheet comprises:

a base sheet; and a coating formed on said base sheet, wherein said coating comprises (1) an aromatic compound having a phenolic hydroxyl group or an amino group directly bonded to an aromatic ring selected from the group consisting of 3,3'-dihydroxydiphenylamine, o-phenylenediamine, 4-chloro-o-phenylenediamine, 4-nitro-o-phenylenediamine, 2,4-tolyenediamine, 5-nitrotolylene-2,4-diamine, 4-methoxy-o-phenylenediamine, 4-methoxy-m-phenylenediamine, p-phenylenediamine, 2-chloro-p-phenylenediamine, 2-nitro-p-phenylenediamine, N,N-dimethyl-p-phenylenediamine, 3-(p-aminoanilino)-1,2-propanediol, p-aminodiphenylamine, p-hydroxydiphenylamine, m-hydroxydiphenylamine, o-methoxy-p'-aminodiphenylamine, p,p'-diaminodiphenylamine, p,p'-bis-dimethylaminodiphenylamine, 4-methoxy-4'-aminodiphenylamine, o-aminophenol, m-aminophenol, 2-amino-4-chlorophenol, 2-amino-4-nitrophenol, 2-amino-5-nitrophenol, picramic acid, p-aminophenol, 4-amino-2-nitrophenol, p-amino-p'-hydroxydiphenylamine, p-amino-m-methyl-p'-hydroxydiphenylamine, 1-naphthol, 4-methoxy-1-naphthol, 1,5-dihydroxynaphthalene, 2,5-dimethoxyaniline, 3,4-methylenedioxyaniline, 1,5-diaminonaphthalene, 2-nitroso-1-naphthol, 1,6-dihydroxynaphthalene, 1,7-dihydroxynaphthalene, 2,6-dihydroxynaphthalene, 2,7-dihydroxynaphthalene, 5-amino-1-naphthol, pyrocatechol, resorcinol, p-aminoacetoanilide, m-phenylenediamine, 4-chloro-m-phenylenediamine, 4-chlororesorcinol, 4-nitro-m-phenylenediamine, 2,5-diaminotoluene, 2-chlorotoluene-3,5-diamine, 4-ethoxy-m-phenylenediamine, pyrogallol, phloroglucin, 2,4-diaminoanisol and anidol, and (2) a quinone compound comprising quinone or a quinone derivative substituted with an electron attractive substituent, wherein said aromatic compound and said quinone compound are in an unreacted state.

2. The transfer sheet of claim 1, wherein said quinone compound has the following formula:

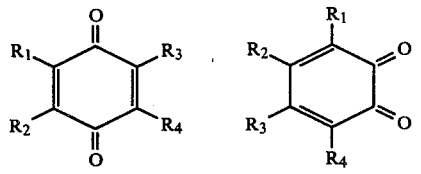

wherein at least one of $R_1$ to $R_4$ represents a halogen atom or a cyano group and the other R substituents represent a hydrogen atom or an alkyl group having 1 to 8 carbon atoms.

3. The transfer sheet of claim 2, wherein said quinone compound is 3,4,5,6-tetrachloro-1,2-benzoquinone, 2,3,5,6-tetrachloro-1-4-benzoquinone, or 2,3-dicyano-5,6-dichloro-1,4-benzoquinone.

4. The transfer sheet of claim 2, wherein said alkyl group has 1 to 3 carbon atoms.

5. The transfer sheet of claim 4, wherein said quinone compound is 3,4,5,6-tetrachloro-1,2-benzoquinone, 2,3,5,6-tetrachloro-1-4-benzoquinone, or 2,3-dicyano-5,6-dichloro-1,4-benzoquinone.

6. The transfer sheet of claim 1, wherein said coating comprises said aromatic compound coated on said base sheet and then said quinone compound coated thereon.

7. The transfer sheet of claim 1, wherein one of said aromatic compound or said quinone compound is encapsulated in said coating and mixed with the other compound in non-encapsulated form.

8. The transfer sheet of claim 1, wherein said coating further comprises coating components selected from the group consisting of solvents, binders, 2,2-bis(4-hydroxyphenyl)propane, calcium chloride, silica, wax, calcium carbonate, a compound having a maximum absorption wavelength of 490 to 560 nm, fluorescent dyes, white pigments, and mixtures thereof, said coating components being in an amount of from 50 to 90% by weight.

* * * * *